United States Patent [19]

Robinson

[11] 4,258,506

[45] Mar. 31, 1981

[54] APPARATUS FOR SCALE AND SLAG REMOVAL

[76] Inventor: Charles E. Robinson, 208 Gardner Ave., Burlington, Wis. 53105

[21] Appl. No.: 3,159

[22] Filed: Jan. 15, 1979

[51] Int. Cl.[3] ..... B24B 7/00; B24B 21/06

[52] U.S. Cl. ..... 51/76 R; 51/138

[58] Field of Search ..... 51/137, 138, 139, 141, 51/61, 76

[56] References Cited

U.S. PATENT DOCUMENTS

| | | | |
|---|---|---|---|
| 781,423 | 1/1905 | Hemming | 51/138 |
| 2,579,603 | 12/1951 | Niederer et al. | 51/137 |
| 3,092,936 | 6/1963 | Marsa | 51/141 |
| 3,553,899 | 1/1971 | Hasegawa | 51/141 |
| 3,603,041 | 9/1971 | McDonald | 51/138 |

*Primary Examiner*—Othell M. Simpson
*Assistant Examiner*—K. Bradford Adolphson
*Attorney, Agent, or Firm*—Wheeler, Morsell, House & Fuller

[57] ABSTRACT

A slag removing machine includes a conveyor movable generally vertically on a parallelogram linkage. The conveyor carries steel slabs below a fixed vertical sanding belt surfacing unit. The conveyor is supported on air bags.

7 Claims, 4 Drawing Figures

APPARATUS FOR SCALE AND SLAG REMOVAL

BACKGROUND OF THE INVENTION

Many slag removal systems are known. However, the present system prevents jamming and feed rate problems and does an excellent job of slag removal.

The closest known prior art includes a machine in which the conveyor travels over a back plate which is suspended on air bags, but in which the remainder of the conveyor is not so suspended. With such a bed plate, changes in the location of the bed plate cause changes in the length of the conveyor and stretch the belt.

There is also a known machine in which the entire sanding belt, with its supports and its drive motor, is pivoted at the center and biased by a pneumatic cylinder toward the work piece. It is very difficult to maintain the unit stable and parallel to the work piece to give a smooth surface. Moreover, the large rotating mass is a problem and the entire machine is unnecessarily complicated.

SUMMARY OF THE INVENTION

The invention here consists of mounting a conveyor for steel slabs on a parallelogram linkage in which the links of the parallelogram are inclined toward the incoming material and the conveyor is upwardly biased to bring the material on the conveyor belt into contact with the fixed surfacing device above it. Preferably the bias is supplied by air bags and preferably the entire conveyor is mounted on the parallelogram linkage rather than just a part of it.

By so mounting the conveyor, the entire conveyor can move downwardly, and toward the input side, when the incoming work pieces such as metal slabs are higher than the distance between the conveyor and the surfacing unit, while maintaining an elastic upward bias toward the surfacing unit. Because the movement of the conveyor downward is also a movement away from the surfacing unit, this tends to relieve the load on the surfacing unit and prevent jamming by slightly decreasing the feed rate. If the links were inclined in the other direction, so that downward movement of the conveyor would bring the work piece toward the surfacing unit, that would tend to produce too great a feed rate and would tend to jam the machine.

DRAWINGS

DESCRIPTION

Figure 3:
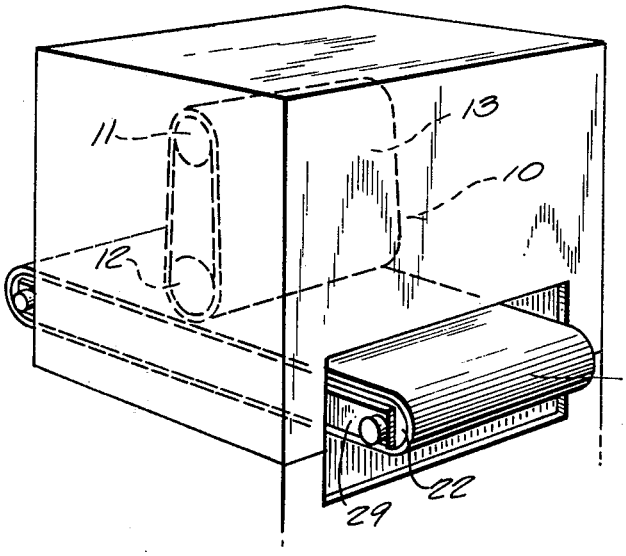
FIG. 3 is a perspective view showing the overall appearance of my device.
Figure 4:
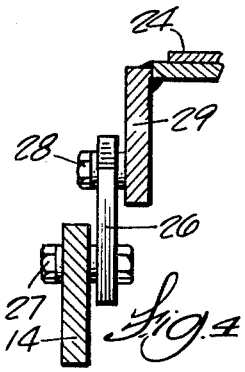
FIG. 4 is a cross sectional view on line 4—4 of FIG. 1 showing details of the parallelogram linkage.

Although the disclosure hereof is detailed and exact to enable those skilled in the art to practice the invention, the physical embodiments herein disclosed merely exemplify the invention which may be embodied in other specific structure. While the best known embodiment has been described, the details may be changed without departing from the invention, which is defined by the claims.

As shown in the drawings, the preferred form of my invention includes an abrasive sanding device 10 including rolls 11 and 12 and an abrasive belt 13. These, together with other conventional structure (not shown) are supported at a fixed height from a base 14.

Figure 1:
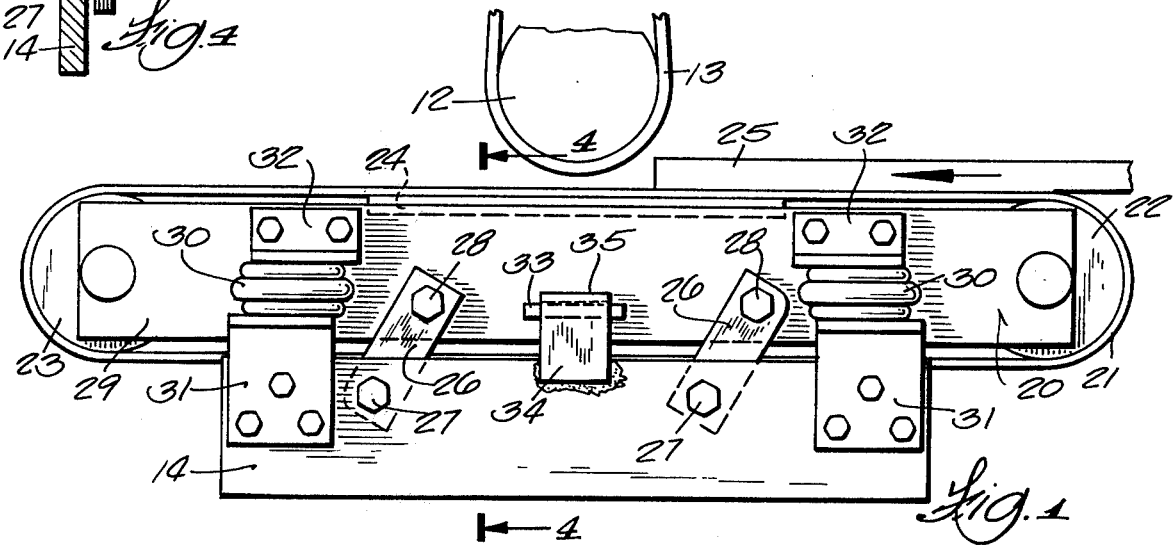
FIG. 1 is a side view of the surfacing conveyor of my device.

A conveyor 20 including a belt 21, end rolls 22 and 23, a bed plate 24, and other conventional structure (not shown) to drive the belt 21, so that as shown in FIG. 1, a work piece 25 is driven to the left in the direction of the arrow. A pair of links 26 at each side of conveyor 20 are pivoted at 27 to the fixed base 14 and pivoted at 28 to the side plates 29 of conveyor 20. The links 26 are inclined so that the upper ends and pivots 28 are closer to the direction from which the work piece is coming than the lower ends and pivots 27.

Figure 2:
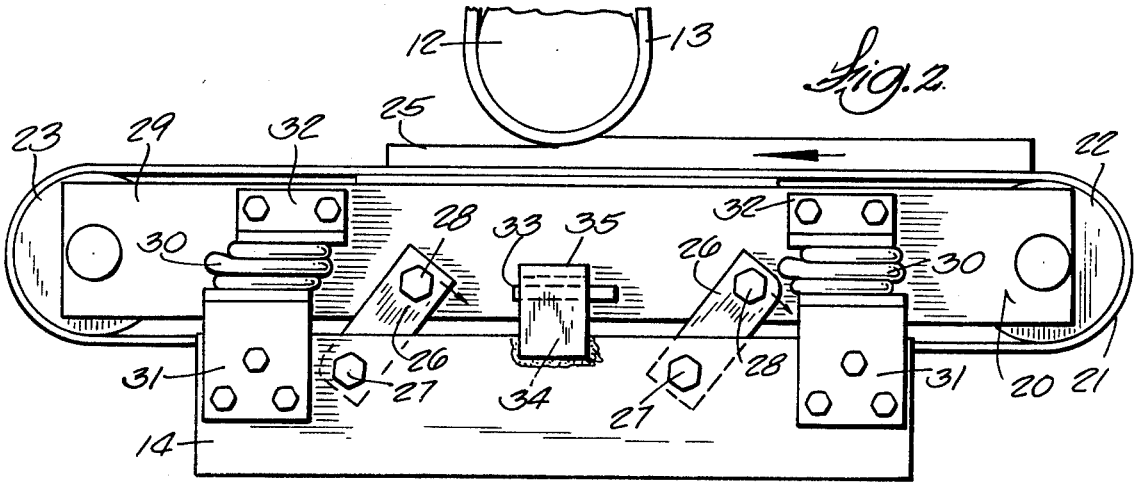
FIG. 2 is a view similar to FIG. 1 in which the surfacing of a steel slab is partly accomplished.

The entire conveyor 20 is biased upwardly toward the fixed abrasive sander 10. In the preferred form of my device the upward bias is provided by pneumatic bags 30 operating between brackets 31 attached to base 14 and 32 attached to conveyor 20. Each bracket includes a horizontal plate, between which bag 30 acts. Upward movement of conveyor 20 is limited by a stop means, here shown as a bar 33 secured to the conveyor side plate 29 and a plate 34 secured to base 14 and having a flange 35 overlying bar 33. Downward movement of conveyor 20 is limited by air bags 30 and supporting brackets 31 and 32. During operation the air bags 30 are inflated to a level which supports conveyor 20 at the desired distance from abrasive belt 13 to surface the work piece as shown in FIG. 2.

Because conveyor 20 and bed plate 24 are supported by air bags 30 in such a manner that the conveyor can move around the pivots 27 and 28 of parallel links 26, a thick section of the work piece, such as slag, causes the conveyor not only to move downwardly, but to back off slightly because of the angle of links 26, thus preventing jamming but maintaining firm contact between abrasive belt 13 and work piece 25 in order to continue to surface the work piece without jamming. Because the sanding belt 13 is in fixed position with respect to the base and the entire conveyor 20 moves on parallel links, the abrasive belt continues to remove slag and unwanted material regardless of dimensional variations. The very slight decrease in feed rate that results from movement of the conveyor downwardly and backwardly with respect to the feed direction when the edge of the work piece or a higher portion of the work piece comes in contact with the abrasive belt 13 is an important advantage.

Likewise, it is preferred that the entire conveyor, rather than merely the bed plate, be suspended in order to avoid changes in the length of the conveyor belt which adversely affect the performance of the conveyor.

I claim:

1. In a machine for surfacing workpieces having surface imperfections difficult to remove, abrasive surfacing means fixed in space with respect to a fixed support, conveyor means including a bed plate under a moving means to carry the workpieces along the bed plate under the surfacing means, the bias means urging the conveyor means toward the surfacing means, the improvement comprising:

the bed plate of the conveyor means being guided on a series of links each having an upper end freely pivoted to a support for the bed plate and a lower end freely pivoted to the fixed support, each said link having the upper end which is pivoted to the bed plate support inclined upwardly toward the portion of the bed plate from which the workpieces are moving.

2. The device of claim 1 in which there are at least two said links at each side of the bed plate and in which all of said links are parallel.

3. The device of claim 1 in which the biasing means comprises pneumatic air bags.

4. The device of claim 1 in which the surfacing means comprises a belt sander having a lower roll extending across the width of the conveyor means and an upper roll above the lower roll, a sanding belt extending over the rolls, and means to drive the rolls and the sanding belt to abrade the surface of the work piece.

5. The device of claim 1 further comprising stop means to limit upward and downward movements of the bed plate.

6. In an apparatus for removing scale and slag from the surface of metal slabs, including surface abrading means, conveyor means to convey the work piece into operative relationship with the surface abrading means, and biasing means to bias the conveyor means to a position in which the workpiece contacts the surface abrading means, the improvement comprising:

a fixed support supporting the entire structure of said conveyor means, a bed plate in said conveyor means movable up and down on parallel links having upper and lower ends, said links each being freely pivoted to the conveyor means at said upper ends and to the fixed support at said lower ends, said upper ends being closer to the direction from which the workpieces enter said conveyor means than the lower ends, said biasing means comprising pneumatic air bags between the fixed support and the conveyor means, and means on said conveyor means and said fixed support adapted to provide support for said conveyor means from said fixed support in order to establish a lowermost position below which said bed plate cannot move.

7. The device of claim 5 further comprising stop means on said conveyor means and on said base coacting to stop upward movement of said conveyor means at a fixed level from said base.

* * * * *